US010584837B2

(12) United States Patent
O'Brien et al.

(10) Patent No.: US 10,584,837 B2
(45) **Date of Patent: *Mar. 10, 2020**

(54) BAR HANGER SYSTEM FOR RECESSED FIXTURES

(71) Applicant: CORDELIA LIGHTING, INC., Rancho Dominguez, CA (US)

(72) Inventors: Aaron O'Brien, Los Alamitos, CA (US); Huan C. Nguyen, Placentia, CA (US)

(73) Assignee: CORDELIA LIGHTING, INC., Rancho Dominigues, CA (US)

( * ) Notice: Subject to any disclaimer, the term of this patent is extended or adjusted under 35 U.S.C. 154(b) by 224 days.

This patent is subject to a terminal disclaimer.

(21) Appl. No.: 15/796,849

(22) Filed: Oct. 29, 2017

(65) Prior Publication Data

US 2018/0119907 A1 May 3, 2018

Related U.S. Application Data

(60) Provisional application No. 62/414,653, filed on Oct. 28, 2016, provisional application No. 62/547,881, filed on Aug. 21, 2017.

(51) Int. Cl.

| | |
|---|---|
| ***F21S 8/02*** | (2006.01) |
| ***F21V 21/22*** | (2006.01) |
| ***F21V 21/04*** | (2006.01) |

(52) U.S. Cl.

CPC ..... *F21S 8/026* (2013.01); *F21V 21/048* (2013.01); *F21V 21/22* (2013.01)

(58) Field of Classification Search

None

See application file for complete search history.

(56) References Cited

U.S. PATENT DOCUMENTS

| | | | |
|---|---|---|---|
| 1,156,885 | A | 10/1915 | Caine |
| 1,350,295 | A | 8/1920 | Champeau |
| 1,622,087 | A | 3/1927 | Calderwood |
| 1,756,361 | A | 4/1930 | Johnson |
| 1,791,480 | A | 2/1931 | Smith et al. |
| 1,821,733 | A | 9/1931 | Thibodeau |
| 2,316,389 | A | 4/1943 | Atkinson |
| 2,518,515 | A | 8/1950 | Austin |
| 2,658,241 | A | 11/1953 | Houghton et al. |
| 2,713,983 | A | 7/1955 | Kay |
| 2,802,933 | A | 8/1957 | Broadwin |
| 2,887,568 | A | 5/1959 | Franck |
| 2,930,564 | A | 3/1960 | Maier |

(Continued)

OTHER PUBLICATIONS http://www.cooperindustries.com/content/dam/public/bline/Resources/Library/catalogs/fasteners_and_fixing/spring_steel_fasteners_NA/Acoustical.pdf retrieved on Nov. 15, 2017, pp. 1-20.

*Primary Examiner* — Elmito Breval

(74) *Attorney, Agent, or Firm* — Paul Y. Feng; One LLP

(57) ABSTRACT

A telescoping hanger bar assembly for mounting a recessed ceiling light fixture, wherein the hanger bar assembly includes mounting brackets each including an ear defining a plane, and each ear includes a nail holder, a bendable flange, and a bendable return. Each ear plane contains the nail holder adjacent to the bendable flange partially separated by a score line. The bendable flange and bendable return allow the hanger bar to be configured by the user for attachment to a T-bar grid, steel studs, furring strips, engineered joists, or standard wooden joists commonly found in building construction.

20 Claims, 4 Drawing Sheets

(56) References Cited

U.S. PATENT DOCUMENTS

| | | | |
|---|---|---|---|
| 2,933,549 | A | 4/1960 | Antonucci |
| 3,040,172 | A | 6/1962 | Chan |
| 3,099,404 | A | 7/1963 | Kaufman et al. |
| 3,102,306 | A | 9/1963 | Hutchinson |
| 3,104,087 | A | 9/1963 | Budnick et al. |
| 3,154,001 | A | 10/1964 | Zurawski |
| 3,162,413 | A | 12/1964 | Hexdall |
| 3,300,634 | A | 1/1967 | Liberman |
| 3,313,931 | A | 4/1967 | Klugman |
| 3,597,889 | A | 8/1971 | Lo Nigro |
| 3,609,338 | A | 9/1971 | Kripp |
| 3,710,096 | A | 1/1973 | McFarlin |
| 4,022,415 | A | 5/1977 | Roderick et al. |
| 4,040,589 | A | 8/1977 | McLay |
| 4,041,657 | A | 8/1977 | Schuplin |
| 4,086,480 | A | 4/1978 | Lahm |
| 4,114,327 | A | 9/1978 | Williams |
| 4,122,762 | A | 10/1978 | Williams |
| 4,149,693 | A | 4/1979 | LoNigro |
| 4,165,851 | A | 8/1979 | Bowden et al. |
| 4,190,355 | A | 2/1980 | Avery et al. |
| 4,230,900 | A | 10/1980 | Speet |
| 4,290,098 | A | 9/1981 | Pierson |
| 4,336,575 | A | 6/1982 | Gilman |
| 4,388,677 | A | 6/1983 | Druffel |
| 4,391,428 | A | 7/1983 | Grimes |
| 4,406,216 | A | 9/1983 | Hott et al. |
| 4,408,262 | A | 10/1983 | Kusmer |
| 4,475,147 | A | 10/1984 | Kristofek |
| 4,511,113 | A | 4/1985 | Druffel et al. |
| 4,519,019 | A | 5/1985 | Hall |
| 4,545,000 | A | 10/1985 | Fraley et al. |
| 4,564,888 | A | 1/1986 | Lewin et al. |
| 4,566,057 | A | 1/1986 | Druffel |
| 4,569,003 | A | 2/1986 | Elmer et al. |
| 4,577,824 | A | 3/1986 | Druffel et al. |
| 4,646,212 | A | 2/1987 | Florence |
| 4,670,822 | A | 6/1987 | Baker |
| 4,723,747 | A | 2/1988 | Karp et al. |
| 4,729,080 | A | 3/1988 | Fremont et al. |
| 4,742,440 | A | 5/1988 | Guzzini |
| 4,754,377 | A | 6/1988 | Wenman |
| 4,757,967 | A | 7/1988 | Delmore et al. |
| 4,760,510 | A | 7/1988 | Lahti |
| 4,760,981 | A | 8/1988 | Hodges |
| 4,762,162 | A | 8/1988 | Chochrek |
| 4,796,169 | A | 1/1989 | Shemitz |
| 4,803,603 | A | 2/1989 | Carson |
| 4,829,410 | A | 5/1989 | Patel |
| 4,872,097 | A | 10/1989 | Miller |
| 4,930,054 | A | 5/1990 | Krebs |
| 4,967,990 | A | 11/1990 | Rinderer |
| 4,972,339 | A | 11/1990 | Gabrius |
| 4,978,092 | A | 12/1990 | Nattel |
| 5,029,794 | A | 7/1991 | Wolfe |
| 5,034,867 | A | 7/1991 | Mayer |
| 5,044,582 | A | 9/1991 | Walters |
| 5,045,985 | A | 9/1991 | Russo et al. |
| 5,057,979 | A | 10/1991 | Carson et al. |
| 5,073,845 | A | 12/1991 | Aubrey |
| 5,074,515 | A | 12/1991 | Carter, Jr. |
| 5,075,828 | A | 12/1991 | Gordin et al. |
| 5,075,831 | A | 12/1991 | Stringer et al. |
| 5,130,913 | A | 7/1992 | David |
| 5,176,345 | A | 1/1993 | Medlin |
| 5,178,503 | A | 1/1993 | Losada |
| 5,209,444 | A | 5/1993 | Rinderer |
| 5,222,800 | A | 6/1993 | Chan et al. |
| 5,291,381 | A | 3/1994 | Price |
| 5,316,254 | A | 5/1994 | McCartha |
| D351,481 | S | 10/1994 | Cole, Jr. |
| 5,374,812 | A | 12/1994 | Chan et al. |
| 5,379,199 | A | 1/1995 | Hirshenhorn et al. |
| 5,386,959 | A | 2/1995 | Laughlin et al. |
| 5,452,816 | A | 9/1995 | Chan et al. |
| 5,457,617 | A | 10/1995 | Chan et al. |
| 5,505,419 | A | 4/1996 | Gabrius |
| 5,571,256 | A | 11/1996 | Good et al. |
| 5,581,448 | A | 12/1996 | Harwood |
| 5,588,737 | A | 12/1996 | Kusmer |
| 5,595,028 | A | 1/1997 | Handzlik |
| 5,597,234 | A | 1/1997 | Winkelhake |
| 5,618,017 | A | 4/1997 | De Boer |
| 5,619,263 | A | 4/1997 | Laughlin et al. |
| 5,623,789 | A | 4/1997 | Kidwell et al. |
| D384,431 | S | 9/1997 | Bitton |
| 5,662,413 | A | 9/1997 | Akiyama |
| 5,662,414 | A | 9/1997 | Jennings et al. |
| 5,678,799 | A | 10/1997 | Jorgensen et al. |
| 5,690,423 | A | 11/1997 | Hentz et al. |
| 5,738,436 | A | 4/1998 | Cummings et al. |
| 5,746,507 | A | 5/1998 | Lee |
| 5,758,959 | A | 6/1998 | Sieczkowski |
| 5,800,051 | A | 9/1998 | Gampe et al. |
| 5,826,970 | A | 10/1998 | Keller et al. |
| 5,845,886 | A | 12/1998 | McCormick |
| 5,857,766 | A | 1/1999 | Sieczkowski |
| 5,873,556 | A | 2/1999 | Reiker |
| 5,934,631 | A | 8/1999 | Becker et al. |
| 5,954,304 | A | 9/1999 | Jorgensen |
| 5,957,573 | A | 9/1999 | Wedekind et al. |
| 5,957,574 | A | 9/1999 | Hentz et al. |
| 6,004,011 | A | 12/1999 | Sieczkowski |
| 6,030,102 | A | 2/2000 | Gromotka |
| 6,033,098 | A | 3/2000 | Hentz et al. |
| 6,076,788 | A | 6/2000 | Akiyama |
| 6,082,878 | A | 7/2000 | Doubek et al. |
| 6,085,916 | A | 7/2000 | Kovacevic et al. |
| 6,105,918 | A | 8/2000 | Gromotka |
| 6,164,802 | A | 12/2000 | Gromotka |
| 6,216,992 | B1 | 4/2001 | Bisonaya et al. |
| 6,231,205 | B1 | 5/2001 | Slesinger et al. |
| 6,286,265 | B1 | 9/2001 | Rinderer |
| 6,296,211 | B1 | 10/2001 | Snyder |
| 6,332,597 | B1 | 12/2001 | Korcz et al. |
| 6,341,466 | B1 | 1/2002 | Kehoe et al. |
| 6,345,800 | B1 | 2/2002 | Herst et al. |
| 6,431,723 | B1 | 8/2002 | Schubert et al. |
| 6,461,016 | B1 | 10/2002 | Jamison et al. |
| 6,471,374 | B1 | 10/2002 | Thomas et al. |
| 6,484,980 | B2 | 11/2002 | Medlin, Sr. et al. |
| 6,505,960 | B2 | 1/2003 | Schubert et al. |
| 6,519,791 | B2 | 2/2003 | Randolph |
| 6,527,406 | B1 | 3/2003 | Slesinger et al. |
| 6,609,690 | B1 | 8/2003 | Davis |
| 6,637,705 | B2 | 10/2003 | Sjoblom et al. |
| 6,688,069 | B2 | 2/2004 | Zadeh |
| 6,691,968 | B1 | 2/2004 | Tseng |
| 6,726,347 | B2 | 4/2004 | Wronski |
| 6,805,916 | B2 | 10/2004 | Cadieu |
| 7,410,276 | B2 | 8/2008 | Fryzek et al. |
| 7,673,841 | B2 | 3/2010 | Wronski |
| 7,735,795 | B2 | 6/2010 | Wronski |
| 7,784,754 | B2 | 8/2010 | Nevers et al. |
| 7,810,775 | B2 | 10/2010 | Dal Ponte et al. |
| 7,832,889 | B1 | 11/2010 | Cogliano |
| 7,896,529 | B2 | 3/2011 | Wronski et al. |
| 8,038,113 | B2 | 10/2011 | Fryzek et al. |
| 8,177,176 | B2 | 5/2012 | Nguyen et al. |
| 8,240,630 | B2 | 8/2012 | Wronski |
| 8,622,361 | B2 | 1/2014 | Wronski |
| 2005/0183344 | A1 | 8/2005 | Ziobro et al. |
| 2005/0247842 | A1 | 11/2005 | Wronksi |
| 2007/0012847 | A1 | 1/2007 | Tai |
| 2007/0075206 | A1 | 4/2007 | Wright et al. |
| 2007/0261881 | A1 | 11/2007 | Wronski |
| 2009/0231861 | A1 | 9/2009 | Wedekind |
| 2010/0224404 | A1 | 9/2010 | Rippel et al. |
| 2014/0301087 | A1 | 10/2014 | Wronski et al. |

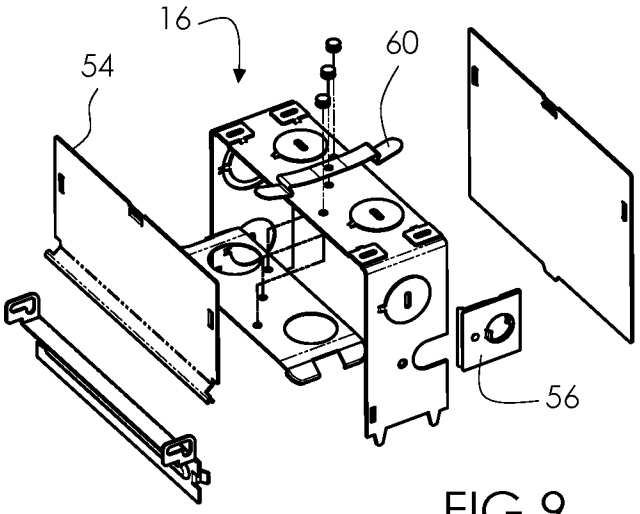
FIG.9
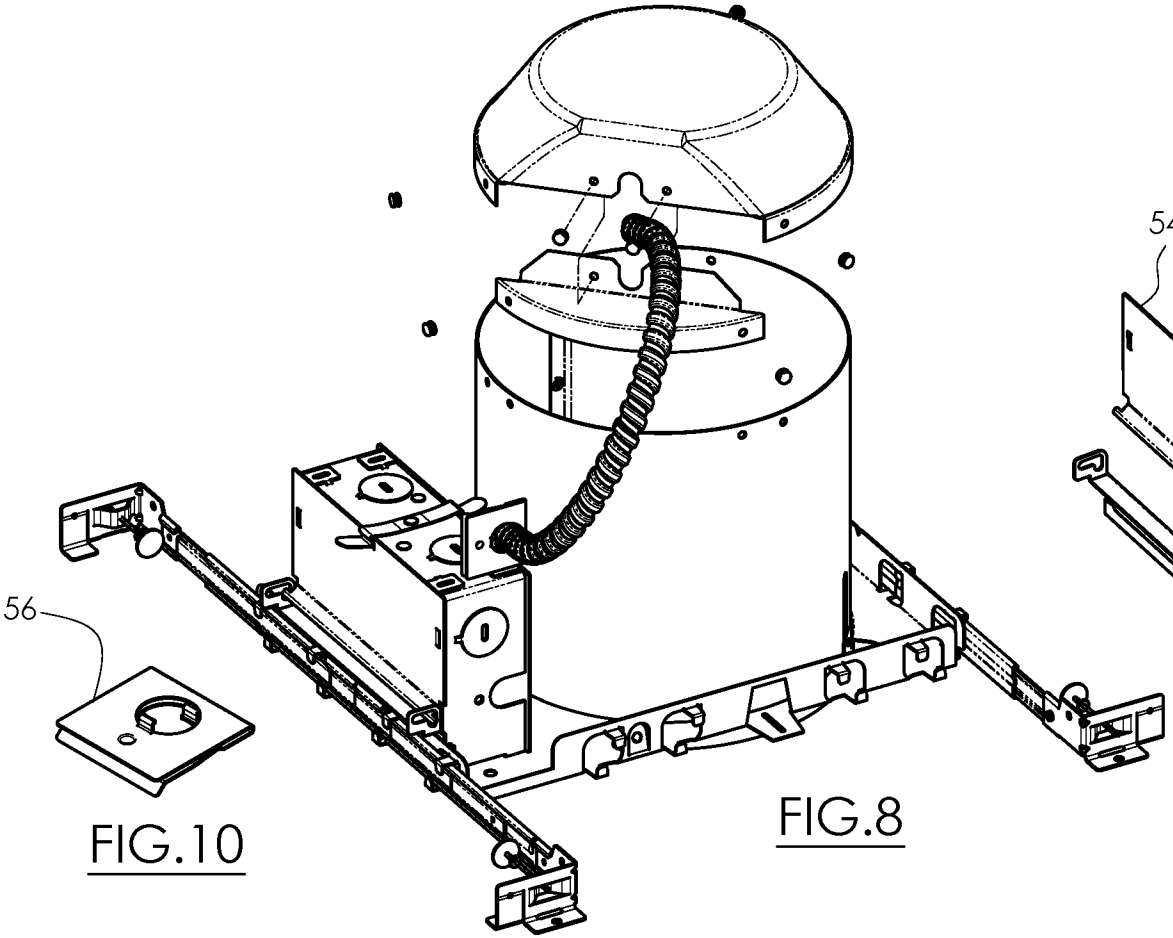
FIG.8
FIG.10

BAR HANGER SYSTEM FOR RECESSED FIXTURES

CROSS-REFERENCE TO RELATED APPLICATIONS

This application claims priority from provisional application No. 62/414,653, filed Oct. 28, 2016, and from provisional application No. 62/547,881, filed Aug. 21, 2017, the contents of all of which are hereby incorporated by reference.

FIELD OF THE INVENTION

The present invention relates to residential and commercial lighting fixtures. In particular, the present invention relates to mounting hardware for ceiling light fixtures or similar luminaires.

BACKGROUND OF THE INVENTION

Recessed lighting fixtures are commonplace in residential homes and commercial buildings. A recessed lighting fixture typically has a metal housing or can, an electrical junction box, and a conical-shaped recessed trim piece to direct and reflect the lighting emitted by a bulb that is in a bulb holder or socket. The recessed lighting "can" is installed above the ceiling in a building or house so that the opening in the can and trim are flush with the ceiling. The light is thus recessed into the ceiling.

The can with a junction box and other hardware are suspended by a pair of hanger bars extending parallel and on opposite sides of the assembly. The hanger bar is typically stamped from steel and is length-adjustable by a telescopic action. The opposite ends of the hanger bar, which resemble ears, are configured to attach to the ceiling support structure.

Specifically, one type of standard ceiling is supported by joists, and the recessed lighting fixture is mounted onto the joists via the hanger bars. When the joists are made of wood or concrete, for example, the hanger bars are usually mounted to the joists with nails, screws or other standard mounting means. The weight of the light fixture is thereby supported by the joists through the hanger bars.

Alternatively, the ceiling may be of the "drop-down" or suspended type. A drop-down ceiling is a secondary ceiling often formed to conceal piping, wiring, HVAC, and/or the floor above. The drop-down ceiling typically consists of a grid-work of metal channels in the shape of an upside-down "T" (i.e., T-bar grid), suspended on wires from an overhead structure. The channels snap together in a regularly spaced pattern, and the resulting cells are filled with lightweight "acoustic ceiling tiles" or "panels" dropped into the grid. Light fixtures may be installed into the grid as desired.

SUMMARY OF THE INVENTION

The present invention is directed to a hanger bar assembly. A preferred embodiment hanger bar assembly includes an elongated first bar having a channel, an elongated second bar slidably disposed inside the channel of the first bar, a first mounting bracket disposed at an end of the first bar, the first mounting bracket including a first ear defining a first plane, and a second mounting bracket disposed at an end of the second bar, the second mounting bracket including a second ear defining a second plane. The first and second ear planes are disposed at a right angle relative to the first and second bars, respectively. Each ear includes a nail holder and an unbent but finger bendable flange adjacent to the nail holder with the nail holder and bendable flange being coplanar and at least partially separated by cut line, each ear further including an unbent but finger bendable return disposed underneath the nail holder and extending away from the respective ear plane. The bendable flange is bendable out of the respective ear plane while the nail holder stays within that ear plane, and the bendable return can be bent to be coplanar within the respective ear plane. An opening is located in each nail holder to slidably receive a mounting nail therein. Thus, the bendable flange and bendable return of the present invention hanger bar can easily hook onto or attach to a T-bar grid, steel studs, furring strips, engineered joists, or standard wooden joists commonly found in building construction.

The hanger bar assembly is preferably fabricated from sheet metal. The bendable flange and bendable return each may optionally include one or more fold lines to enable easy bending by the user under finger pressure and without tools. An optional through hole may be located at about the fold line to further ease bending force. The bendable flange and/or the bendable return may include one or a plurality of fold lines. The bendable return may include a fastener hole. At least one of the first and second bars may include a centerline indicator to help the user align the hanger bar relative to the lighting fixture and other mounting hardware.

BRIEF DESCRIPTION OF THE DRAWINGS

FIG. 8 is an exploded view of the housing assembly from FIG. 1.

FIG. 9 is an exploded view of the junction box.

FIG. 10 is a magnified view of a grommet for the junction box in FIG. 9.

DETAILED DESCRIPTION OF THE PREFERRED EMBODIMENTS

The present invention in a preferred embodiment is directed to a hanger bar system for supporting recessed light fixtures. An example of such a hanger bar system is disclosed in U.S. Pat. No. 8,177,176 (Nguyen, et al.) titled "Hanger Bar For Recessed Lighting Fixtures," the entire contents of which are incorporated by reference.

Figure 12:
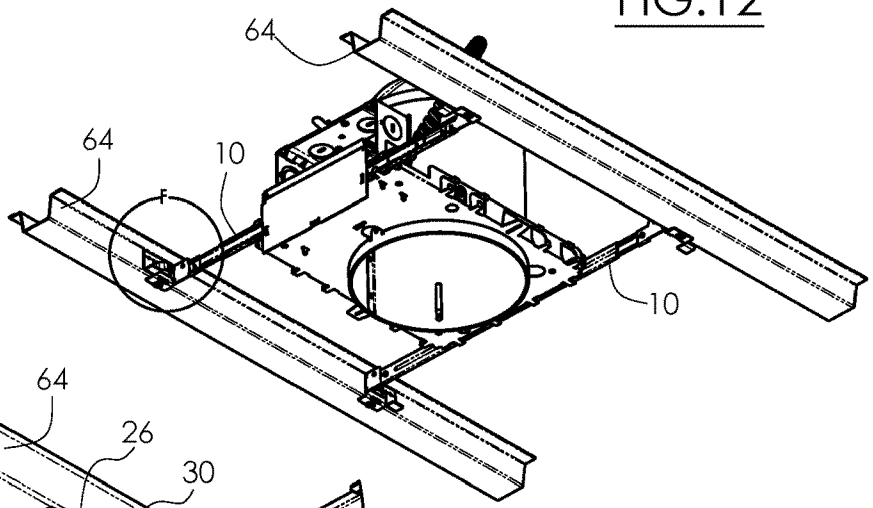
FIG. 12 shows the hanger bar assembly installed to a furring channel.
Figure 11:
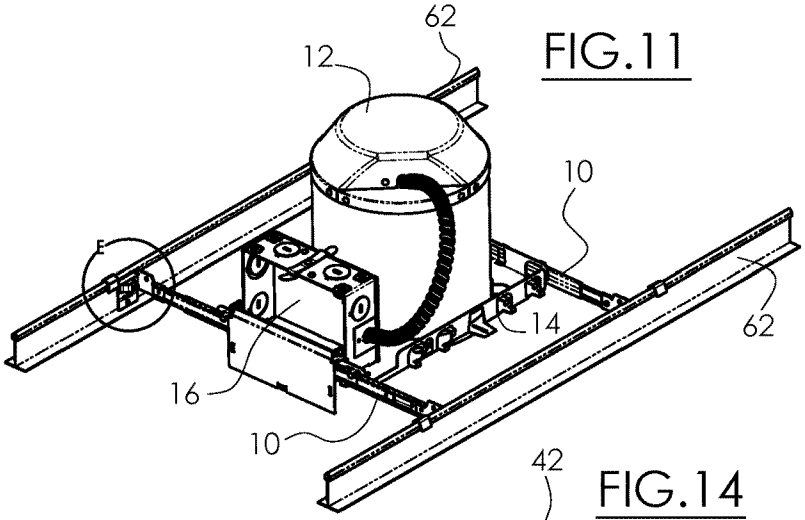
FIG. 11 shows the hanger bar assembly installed to a T-bar.
Figure 14:
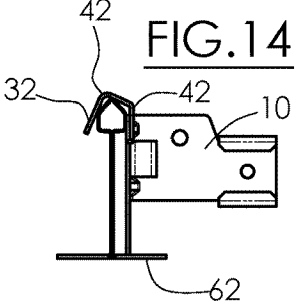
FIG. 14 is a side elevational view of the bendable flange bent over and latched on to a T-bar.
Figure 13:
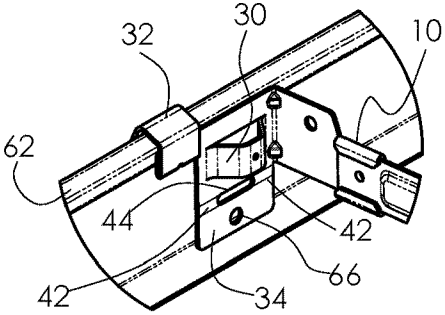
FIG. 13 shows the bendable flange bent for attachment to a T-bar.

As seen in drawing FIGS. 11-16, the "footprint" of the mounting bracket for the present invention hanger bar system 10, which interfaces with the building structure, is preferably small enough to work with commonly available steel studs, furring strips, engineered joists and standard wooden joists. While maintaining that height, the bar hanger system 10 can still work with a T-bar grid as seen in FIGS. 11, 13, 14. The position of the integral mounting nail 38 is low enough to engage a 1" trade size piece of lumber. The position will put the nail 38 close to the lumber center line. The position is not new, but the fact that the hanger bar system 10 can mount to traditional ceiling joists and also be easily configured to work with a grid system or furring channels is novel and non-obvious.

Conventional bar hanger systems have a transition from the section which interfaces with a plaster frame to the footprint. At the transition point, many conventional systems increase the height and incorporate a cavity that can accept a T-bar from a grid ceiling. The additional height needed to clear a T-bar is too tall to fit within the height of common metal studs. Since the height is on the transition point, there is no flexibility to bend the additional height out of the way. The present invention addresses this and many other problems.

Figures 1, 2, 3:
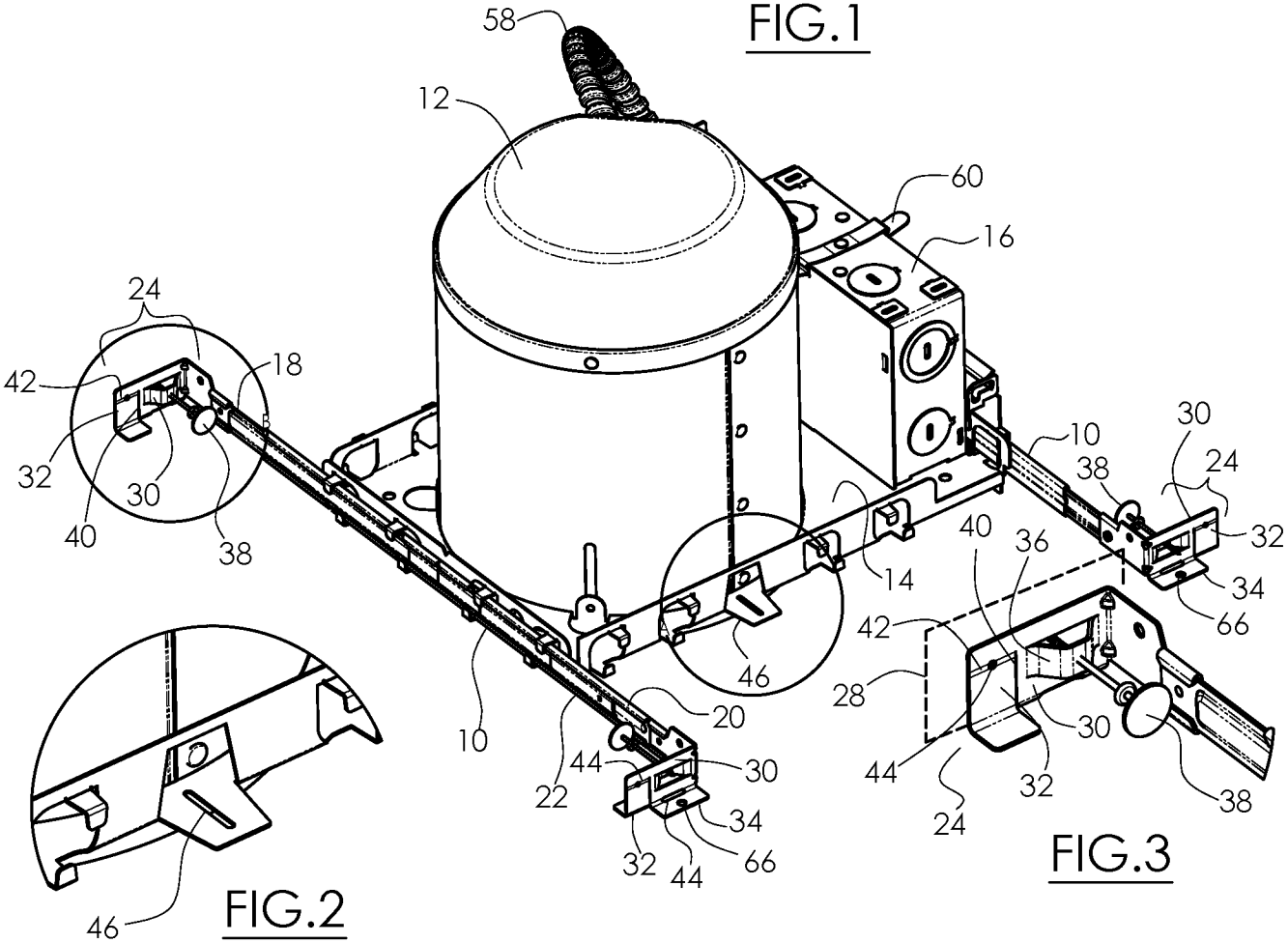
FIG. 1 is a perspective view of a preferred embodiment hanger bar assembly supporting a housing assembly including a can, a pan, and a junction box.
FIG. 2 is a magnified view of a centerline indicator structure of the pan.
FIG. 3 is a magnified view of a mounting bracket of a hanger bar assembly.

As seen in FIGS. 1 and 3, the preferred embodiment hanger bar 10 has a mounting bracket 24 with a flexible portion or bendable flange 32 that can be bent over and hooked on to a T-bar for a grid ceiling. This flexible portion/bendable flange 32 can be bent above the position of the integral mounting nail or to the side of the integral nail 38. The bendable material is long enough to bend over the top and secure the bar system to the grid. There is a small bendable return 34 under the integral nail 38 which is also bent down to raise the height of the hanger bar system to provide enough space for the bars to sit on the edge of the grid and have the plaster frame clear the thickness of the ceiling tile. In either example, a small hole 44 is optionally used to provide a weak spot to make it easier to bend in the right place.

The present invention hanger bars also feature an optional center mark 48 to be used for reference by the user during installation. When the product is installed in locations where the studs are 16" on center, nominal, the hanger bar system 10 will have notches that align with each bar and a center mark on the plaster frame to help indicate if the fixture is centered between the studs. The bar system is designed to work with a recessed light fixture and they are preferably an integral part of the assembly for a finished product.

FIG. 1 shows a perspective view of a preferred embodiment hanger bar system 10 used to support a can 12 and a pan 14 for a recessed light fixture or like luminaire (not shown). A junction box 16 containing the electrical wiring is situated on the pan 14. The hanger bar system 10 includes an elongated outer bar 20 with a channel 22 that slidably holds an elongated inner bar 18 therein, giving the two a telescoping action. The channel 22 can be formed simply by folding over the edges of the outer bar 20 or similar technique. At each end of the two bars 18, 20, is a mounting bracket 24 with an ear 26. Each mounting bracket 24 is intended to mount the hanger bar system 10 to a T-bar, ceiling joist, furring strip or like building construction frame. The ear 26 defines an ear plane 28 (dashed lines in FIG. 3) that is generally arranged at a right angle relative to the lengths of the bars 16, 18.

The hanger bar assembly 10 and its components are preferably made from sheet metal and optionally zinc plated or made from stainless steel. Certain components of the sheet metal have been intentionally weakened by score lines, cut lines, or holes to allow easy bending at predetermined fold lines. The hanger bar assembly can thus be easily configured in the field by the user for installation to a T-bar, furring strips, wooden joists, engineered joists, and like construction framing structures.

FIGS. 1 and 3 show a preferred embodiment ear 26, which includes a nail holder 30, a bendable flange 32, and a bendable return 34. The nail holder 30 and the bendable flange are situated adjacent to each other and coplanar with each other and the ear plane 28. FIG. 3 shows that the nail holder 30 may have a raised platform 36 with a hole therein to slidably hold a nail 38 or like fastener. The nail 38 is removable if not needed.

Still in FIG. 3, the bendable flange 32 and nail holder 30 are at least partially separated by a cut line or score line 40. The cut line is an actual cut through the sheet material, while the score line is a deep cut that does not perforate through the material, but minor finger pressure can fracture and split the sheet along the score line. The cut or score line 40 extends partially between the interface between the bendable flange 32 and the nail holder 30 so the bendable flange 32 can be moved independently from the nail holder 30.

The bendable flange 32 optionally includes one or more bend or fold lines 42; these are weakened or scored areas of the material enabling the user by applying finger pressure to easily bend the bendable flange 32 to any out-of-plane angle needed. FIG. 3 shows the bendable flange 32 in the initial, unbent position, while FIG. 14 shows the bendable flange 32 bent into a bent position, the two positions preferably separated by up to about 360 degrees. The fold line or lines 42 may be further weakened by including one or more holes 44 to facilitate easier bending. The weakened areas at the bend line or lines 42 permit plastically deforming the bendable flange 32 so that the orientation of the nail holder 30 within the ear plane 28 remains relatively undisturbed. This ensures that as the ears 26 are aligned when mounted to a ceiling joist or T-bar, and this alignment is not thrown off dramatically by the bendable flange 32 being bent. The bendable flange 32 preferably has an L-shape in the unbent position shown in FIGS. 1, 3.

The preferred embodiment hanger bar system 10 includes a bendable return 34 preferably located underneath the nail holder 30 and nail 38, as best seen in FIG. 1. The bendable return 34 generally extends perpendicularly away from the ear plane 28 and generally from the opposite face from the nail 38. The bendable return 34 optionally includes fold lines 42 that may include one or more holes 44 to weaken the material along that area to decrease the force needed to make the bend.

Figures 4, 5, 6, 7:
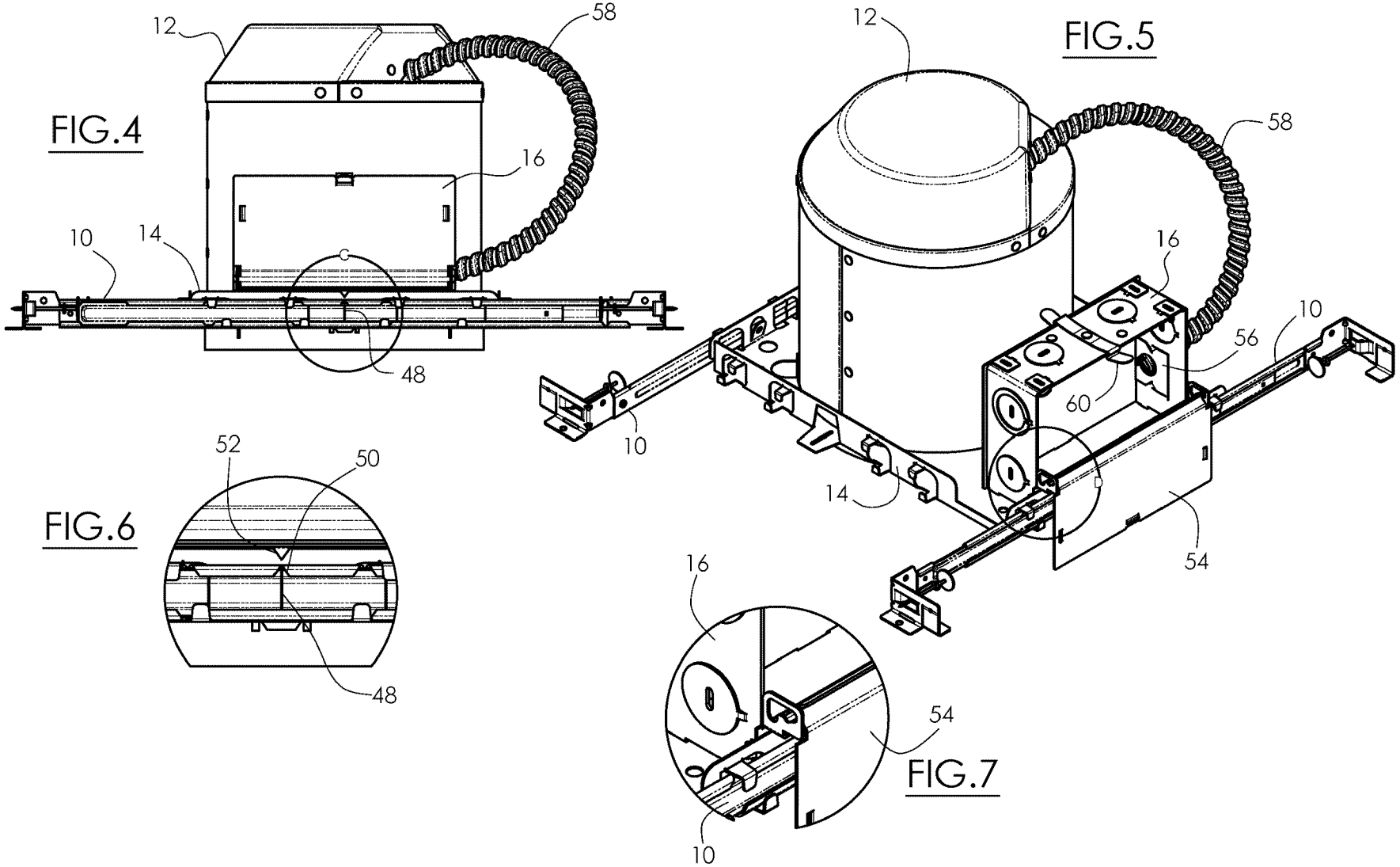
FIG. 4 is a side elevational view of the hanger bar assembly and the housing assembly.
FIG. 5 is a perspective view of the hanger bar assembly supporting the housing assembly as seen from a different angle than FIG. 1.
FIG. 6 is a magnified view of a centerline indicator on the hanger bar.
FIG. 7 is a magnified view of the hinge mechanism in the door of the junction box.

The hanger bar system 10 supports a recessed lighting housing assembly that includes the can 12, the pan 14, and the junction box 16. FIGS. 1 and 2 depict a guide tab 46 with an elongated center slot to indicate to the user the centerline of the housing assembly. This is useful for plaster ceiling applications where the hanger bars 10 may include a center notch 50 or center score line or marking 48 as seen in FIG. 6. The pan 14 may itself include a centerline notch or indicator 52. All of these structures help the user center and align the housing assembly with the hanger bar assembly (FIG. 4) during installation especially in a plaster ceiling application where there are no guides.

FIGS. 1, 4, 5, 8 and 9 show a preferred embodiment junction box 16 mounted to the pan 14. FIG. 5 shows that a wall or door 54 of the junction box 16 may swing open or closed for easy electrician or installer access. FIG. 7 is a magnified, detail view of the hinge mechanism for the junction box door 54. FIG. 10 is a magnified, detail view of a grommet 56 that fits along a wall of the junction box 16. The grommet 56 ensures more secure fitment and attachment of the flexible conduit 58 containing wiring for the lighting fixture. As seen in FIG. 7, the top of the junction box has a snap hook 60 that latches the door 54 shut.

FIGS. 1, 4, 5, 8-10 further show a preferred embodiment housing assembly to be used with LED based trims. This housing or can 12 is preferably smaller and easier to install in the ceiling than conventional housings. The present embodiment housing preferably eliminates the three screws which are typically used to hold the housing in the plaster frame. They are replaced by mounting tabs. Since the mounting tabs are spring-loaded, they include a "C" shaped ring that slides over the housing, below the ceiling, to prevent it from sliding deep into the ceiling when the ceiling is thicker than ½ inch. This preferred embodiment housing only accepts trims which use friction blades for mounting. There is a rib element in the drawings which the friction blade trims will ride over to help retain them in the housing.

The current embodiment adds a one-piece housing with a curled edge at the ceiling opening to enclose an LED trim within the ceiling. It also adds a pair of spring enabled mounting tabs. These tabs eliminate the fasteners typically used to mate the housing with a plaster frame. They also pull the housing up to help make the housing flush with the ceiling.

The housing assembly also includes a structure to interface with many friction blade trims so that the trims stay tight in the ceiling. See, for example, U.S. Pat. No. 7,410,276 (Fryzek et al.), FIG. 7. Current housings with this feature are made specifically to work in conjunction with the spring designed to interface with this feature. The present housing is shaped and positioned to accept multiple spring designs. The preferred embodiment housing is more preferably designed to work only with trims that have an LED light source. The housing height is preferably 3.5" or less.

FIGS. 11, 13, 14 show the preferred embodiment hanger bar system 10 adapted and mounted to a standard T-bar 62. The magnified, detail view of FIG. 13 shows the bendable flange 32 partially deformed and bent backward almost 360 degrees to hang over the T-bar 62. The nail holder 30 maintains its initial position within the ear plane 28. The bendable return 34 which used to jut away from the ear plane 28 has been deformed and bent to be coplanar with the ear plane 28. Thus, the bendable return 34 and nail holder 30 abut flush against the T-bar 62. FIG. 14 depicts the same thing as FIG. 13 except from a side elevational view. The bendable flange 32 bends at the pre-made fold lines 42.

Figure 15:
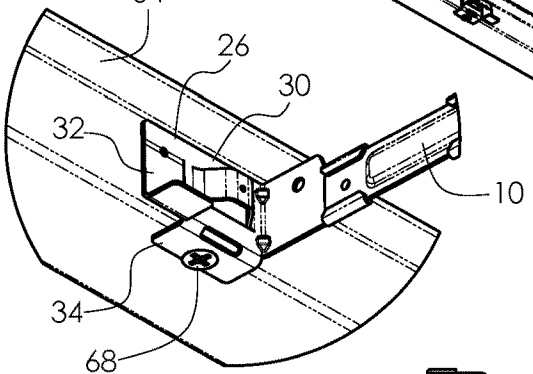
FIG. 15 is a perspective view of the bendable return attached to a furring channel.
Figure 16:
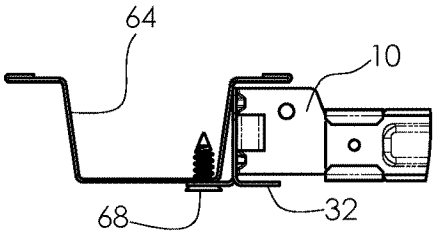
FIG. 16 is a side elevational view of the bendable return attached to a furring channel.

FIGS. 12, 15, 16 show the hanger bar system as installed to a furring channel 64. FIG. 15 is a magnified, detail view of the ear 26 with the bendable flange 32 in its unbent position and generally coplanar with the nail holder 30, both of which abut with the furring channel 64. The bendable return 34 extends underneath the furring channel 64. A fastener hole 66 in the bendable return 34 allows a screw, nail, or like fastener 68 to be driven therethrough to attach the bendable return 34 to the furring channel 64. FIG. 16 is a side elevational view of the arrangement shown in FIG. 15.

In an installation to a traditional wood ceiling joist (not shown), for example, the hanger bar system 10 with the bendable flange 32 and bendable return 34 as configured (unbent) in FIG. 1 can be abutted against the joist and attached to it by driving the nail 38 into the joist. The bendable return 34 fits underneath the bottom of the joist for easy and level alignment. If the user wishes to mount the hanger bar system 10 vertically higher, then the bendable return 34 could be deformed to be coplanar with the ear plane 28 containing the nail holder 30 and bendable flange 32. The structure of the ear 26 would then abut flush against the ceiling joist.

While particular forms of the invention have been illustrated and described, it will be apparent that various modifications can be made without departing from the spirit and scope of the invention. It is contemplated that components from one embodiment may be combined with components from another embodiment.

What is claimed is:

1. A hanger bar assembly for mounting a recessed lighting fixture, comprising:

an elongated first bar having a channel;

an elongated second bar disposed within the channel, wherein the second bar moves within the channel for a telescoping action;

a first bracket disposed at an end of the first bar, the first bracket including a polygonal first ear defining a first plane;

a second bracket disposed at an end of the second bar, the second bracket including a polygonal second ear defining a second plane;

the first and second ear planes disposed at a right angle relative to the first and second bars, respectively, and wherein each ear includes a nail holder with a hole, a bendable flange adjacent to the nail holder with the nail holder and bendable flange being coplanar, and a bendable return disposed underneath the nail holder and extending away from the respective ear plane;

wherein the bendable flange includes an unbent position and a bent position with the two positions separated by up to about 360 degrees, and the bendable flange is bendable independent from the nail holder; and wherein the bendable return can be bent to be coplanar within the respective ear plane.

2. The hanger bar of claim 1, wherein each ear includes at least one of a cut line and a score line located in between the bendable flange and the nail holder.

3. The hanger bar of claim 1, wherein the nail holder includes a nail slidably inserted in the hole.

4. The hanger bar of claim 1, wherein the bendable flange includes a through hole disposed at a fold line thereof.

5. The hanger bar of claim 1, wherein the bendable return includes a through hole disposed at a fold line.

6. The hanger bar of claim 1, wherein the bendable flange includes an L-shape.

7. The hanger bar of claim 1, wherein the hanger bar is fashioned from sheet metal.

8. The hanger bar of claim 1, wherein the second bar includes a centerline indicator.

9. The hanger bar of claim 1, wherein the bendable return includes a fastener hole.

10. A hanger bar assembly for mounting a recessed lighting fixture, comprising:

an elongated first bar having a channel;

an elongated second bar slidably disposed inside the channel of the first bar;

a first bracket disposed at an end of the first bar, the first bracket including a first ear defining a first plane;

a second bracket disposed at an end of the second bar, the second bracket including a second ear defining a second plane;

wherein the first and second ear planes are disposed at a right angle relative to the first and second bars, respectively;

wherein each ear includes a nail holder and a bendable flange adjacent to the nail holder with the nail holder and bendable flange being coplanar and at least partially separated by a cut line, each ear further including a bendable return disposed underneath the nail holder and extending away from the respective ear plane;

wherein the bendable flange includes an unbent position and a bent position, and the bendable flange is movable and bendable independently from the nail holder; and wherein the bendable return can be bent to be coplanar within the respective ear plane.

11. The hanger bar of claim 10, wherein the bendable flange and bendable return each includes a through hole at a fold line.

12. The hanger bar of claim 10, wherein the bendable flange includes a plurality of fold lines.

13. The hanger bar of claim 10, wherein the bendable return includes a fastener hole.

14. The hanger bar of claim 10, wherein at least one of the first and second bars includes a centerline indicator.

15. A hanger bar assembly for mounting a recessed lighting fixture, comprising:

an elongated first bar having a channel;

an elongated second bar slidably disposed inside the channel of the first bar;

a first mounting bracket disposed at an end of the first bar, the first mounting bracket including a first ear defining a first plane;

a second mounting bracket disposed at an end of the second bar, the second mounting bracket including a second ear defining a second plane;

wherein the first and second ear planes are disposed at a right angle relative to the first and second bars, respectively;

wherein each ear includes a nail holder and an L-shape bendable flange adjacent to the nail holder with the nail holder and bendable flange being coplanar with the ear plane and at least partially separated by a cut line, each ear further including a bendable return disposed underneath the nail holder and extending away from the respective ear plane;

wherein the bendable flange is bendable out of the respective ear plane while the nail holder stays within that ear plane;

wherein the bendable return can be bent to be coplanar within the respective ear plane; and an opening in each nail holder to slidably receive a nail therein.

16. The hanger bar of claim 15, wherein at least one of the first and second bars includes a centerline score line.

17. The hanger bar of claim 15, wherein the bendable flange includes a plurality of fold lines.

18. The hanger bar of claim 17, wherein at least one fold line of the bendable flange includes a hole.

19. The hanger bar of claim 15, wherein the bendable return includes a plurality of fold lines.

20. The hanger bar of claim 19, wherein at least one fold line of the bendable return includes a hole.

* * * * *